US011117793B1

(12) United States Patent
Khan et al.

(10) Patent No.: US 11,117,793 B1
(45) Date of Patent: Sep. 14, 2021

(54) CONTACTLESS AUTOFILL DISPENSING

(71) Applicant: PepsiCo Inc., Purchase, NY (US)

(72) Inventors: Kazim A. Khan, Nanuet, NY (US); Terry Tae-il Chung, New Fairfield, CT (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/931,245

(22) Filed: Jul. 16, 2020

(51) Int. Cl.
*B67D 1/12* (2006.01)
*B67D 1/00* (2006.01)

(52) U.S. Cl.
CPC ..... *B67D 1/1236* (2013.01); *B67D 1/0081* (2013.01); *B67D 1/1238* (2013.01); *B67D 2001/009* (2013.01)

(58) Field of Classification Search
CPC .. B67D 1/1236; B67D 1/1238; B67D 1/0081; B67D 2001/009
USPC ..... 222/55, 63; 141/83, 94–95, 177, 192, 141/198
See application file for complete search history.

(56) References Cited

U.S. PATENT DOCUMENTS 4,733,095 A * 3/1988 Kurahashi ..... G01F 23/292 250/577
4,972,883 A * 11/1990 Hassell ..... A47J 31/402 141/1
5,491,333 A * 2/1996 Skell ..... G01F 23/2921 250/222.1
6,082,419 A * 7/2000 Skell ..... B67D 1/1238 141/198
7,199,388 B2 * 4/2007 Omatoi ..... G01F 23/2922 250/573
7,690,403 B2 * 4/2010 You ..... B67D 1/0871 141/83
8,162,011 B2 * 4/2012 Weems ..... B67D 1/1243 141/95
8,338,811 B2 * 12/2012 Lang ..... G01F 23/2925 250/577
9,027,788 B2 * 5/2015 Ophardt ..... G01F 23/2928 222/41
9,126,818 B2 * 9/2015 Chase ..... G07F 13/065
9,796,575 B2 * 10/2017 Deng ..... A47J 31/4457
9,908,768 B2 * 3/2018 Ashrafzadeh ..... B67D 1/1238
10,040,679 B2 * 8/2018 Choi ..... G01F 23/296
10,829,362 B2 * 11/2020 Chernov ..... B67D 1/0888
10,858,235 B2 * 12/2020 Jung ..... B01D 35/04
2006/0123901 A1 * 6/2006 Ramus ..... G01F 23/292 73/290 R
2012/0279987 A1 * 11/2012 Ophardt ..... G01F 23/2927 222/23

(Continued)

*Primary Examiner* — Donnell A Long
(74) *Attorney, Agent, or Firm* — Sterne, Kessler, Goldstein & Fox P.L.L.C.

(57) ABSTRACT

A contactless autofill dispenser includes a housing and a dispense area for receiving a cup. The dispenser includes a supply of consumable product disposed within the housing. The dispenser includes an outlet connected to the supply and extending from the housing into the dispense area for dispensing the consumable product into the cup. The dispenser includes a controller disposed within the housing and connected to the supply, wherein the controller is configured to control dispensing of the consumable product from the outlet. The dispenser includes a time of flight sensor attached to or with a direct line of sight into the dispense area and connected to the controller.

19 Claims, 6 Drawing Sheets

(56) References Cited

U.S. PATENT DOCUMENTS

2012/0314059 A1* 12/2012 Hoffmann ..... G06T 7/0004
348/135
2017/0319014 A1* 11/2017 Ophardt ..... A47K 10/24

* cited by examiner

CONTACTLESS AUTOFILL DISPENSING

FIELD

Embodiments described herein generally relate to beverage dispensing. Specifically, embodiments described herein relate to contactless autofill beverage dispense using a time of flight sensor.

BACKGROUND

Dispensers may dispense beverages, ice, or solid food in response to direct user interaction with the dispensers. For example, users may push an activation button or lever to initiate dispensing. User interaction can transfer germs to the dispenser creating health hazards for the future users.

BRIEF SUMMARY OF THE INVENTION

Some embodiments described herein relate to a contactless autofill beverage dispenser including a housing; a dispense area for receiving a cup; a supply of consumable product disposed within the housing; an outlet connected to the supply and extending from the housing into the dispense area for dispensing the consumable product into the cup; a controller disposed within the housing and connected to the supply, where the controller is configured to control dispensing of the consumable product from the outlet; and a time of flight sensor with a direct line of sight into the dispense area and connected to the controller.

In any of the various embodiments discussed herein, the instructions when executed by the computer cause the computer to automatically sense a presence of the cup within the dispense area and to automatically instruct the controller to initiate dispensing based upon the signal reflected off the cup.

In any of the various embodiments discussed herein, the instructions when executed by the computer cause the computer to automatically calculate a distance between the time of flight sensor and the cup based upon a time between emission of the signal by the emitter and receipt of the signal reflected off the cup.

In any of the various embodiments discussed herein, the instructions when executed by the computer cause the computer to determine a characteristic of the cup based upon the distance between the time of flight sensor and the cup.

In any of the various embodiments discussed herein, the characteristic is a volume and the computer automatically instructs the controller to control dispensing based upon the volume.

In any of the various embodiments discussed herein, the signal is infrared laser light.

In any of the various embodiments discussed herein, automatically instruct a controller of the dispenser to control dispensing based upon the signal reflected off the cup includes continuously monitoring a fill level of consumable product within the cup and instructing the controller to terminate dispensing upon determining that the fill level has reached a predetermined threshold.

In any of the various embodiments discussed herein, the time of flight sensor includes a first time of flight sensor mounted to the dispenser adjacent to the outlet with a direct line of sight into a bottom of the dispense area for holding the cup; and a second time of flight sensor mounted to the dispenser between the outlet and the bottom of the dispense by with a direct line of sight across the dispense area for viewing a side of the cup.

Some embodiments described herein relate to a contactless dispenser having a housing; a dispense area for receiving a cup; a supply of consumable product disposed within the housing; an outlet connected to the supply and extending from the housing into the dispense area for dispensing the consumable product into the cup; a controller disposed within the housing and connected to the supply, wherein the controller is configured to control dispensing of the consumable product from the outlet; and a time of flight sensor for enabling contactless dispensing. The time of flight sensor having an emitter configured to emit an infrared laser light towards the cup; a receiver configured to receive the infrared signal reflected off of the target object; and a computer including a non-transitory computer-readable medium having instructions that when executed by the computer cause the computer to automatically control the emitter to emit the infrared laser light; control the receiver to receive the infrared signal reflected off of the target object; and automatically instruct the controller to control dispensing based upon the infrared signal reflected off the target object.

In any of the various embodiments discussed herein, automatically instruct the controller to control dispensing is further based upon a distance between the cup and the time of flight sensor calculated by the time of flight sensor based upon a time for the infrared laser light to travel from the emitter to the cup and back to the receiver.

Some embodiments described herein relate to a method of contactless dispensing from a dispenser. The method including automatically sensing, with a time of flight sensor of the dispenser, a presence of a cup; automatically determining, with the time of flight sensor, a characteristic of the cup in response to the sensed presence of the cup; dispensing a consumable product from the dispenser based upon the presence of the cup and the characteristic of the cup; continuously monitoring, with the time of flight sensor, a fill level of dispensed consumable product within the cup; determining that the fill level has reached a predetermined threshold based upon the continuously monitored fill level; and terminating dispensing of the consumable product based upon the determination that the fill level has reached the predetermined threshold.

In any of the various embodiments discussed herein, the time of flight sensor comprises a first time of flight sensor and a second time of flight sensor, automatically sensing the presence of the and automatically determining a characteristic of the cup is performed by the first time of flight sensor, and continuously monitoring the fill level is performed by the second time of flight sensor.

In any of the various embodiments discussed herein, wherein automatically determining a characteristic of the cup includes calculating a distance between the cup and the time of flight sensor based upon a time for infrared laser light to travel from the time of flight sensor to the cup and back to the time of flight sensor.

In any of the various embodiments discussed herein, the characteristic of the cup is a volume of the cup.

In any of the various embodiments discussed herein, continuously monitoring the fill level of dispensed consumable product within the cup includes calculating a distance between the cup and the time of flight sensor based upon a time for infrared laser light to travel from the time of flight sensor to the cup and back to the time of flight sensor.

In any of the various embodiments discussed herein, the method further includes performing an automatic top off of the consumable product subsequent to determining that the fill level has reached the predetermined threshold and prior to terminating dispensing of the consumable product.

In any of the various embodiments discussed herein, the entirety of the method is performed without direct user contact with the dispenser.

In any of the various embodiments discussed herein, the method further includes placing a cup in a dispense area of the dispenser without a user directly contacting the dispenser.

BRIEF DESCRIPTION OF THE DRAWINGS

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
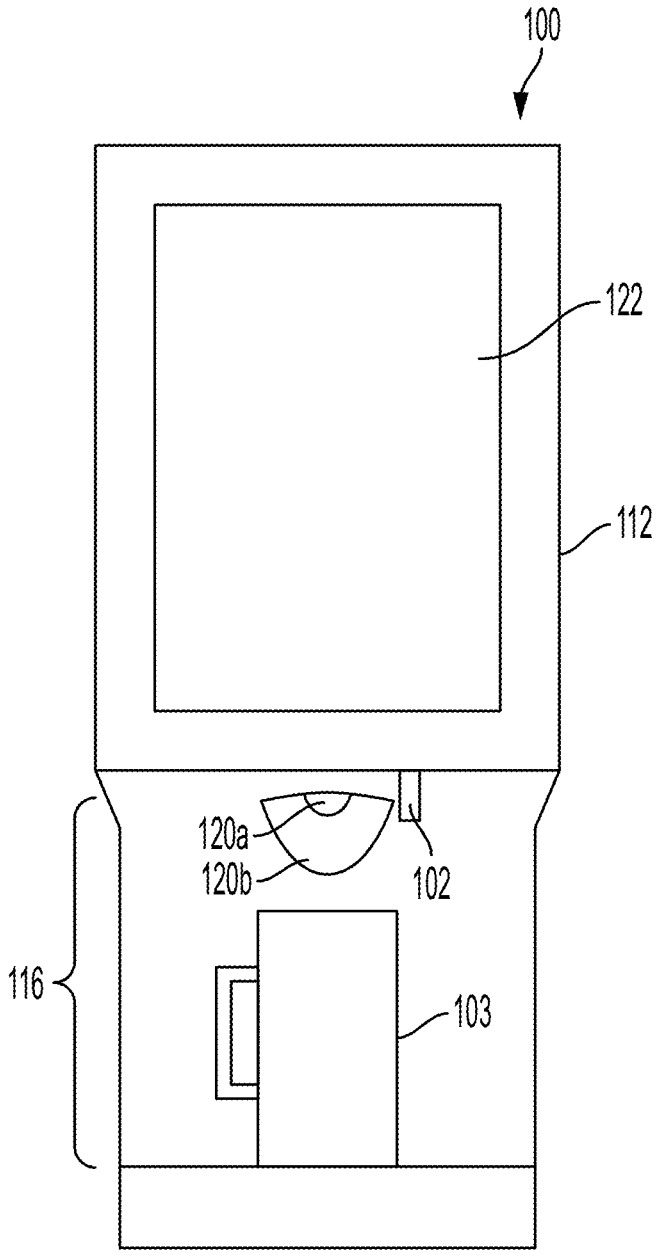
FIG. 1 shows a view of an example beverage dispenser according to an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Traditional beverage and ice dispensers require user interaction (e.g., direct or indirect contact with the dispenser) to initiate or terminate dispensing. For example, dispensers may require a user to push an activation button or push a cup against an activation lever in order to dispense beverages or ice. This user interaction for traditional beverage dispensers is undesirable for a number of reasons.

First, there can be healthy safety issues posed by traditional dispensers. Germs from the user (e.g., on unwashed hands) can be transferred to the dispenser when users push buttons or activate levers of the dispenser to dispense beverages or ice. Nozzles on many traditional dispensers are often located only a few inches below levers or other areas of the dispensers that require user interaction. Germs from a user can migrate to these nozzle openings and multiply, thereby contaminating beverages or ice of future unsuspecting users.

The issue of user contamination of dispensers is compounded by the environments in which the dispensers are often installed. For example, in restaurants with help-yourself or self-serve style dispensers, users often interact with the dispensers immediately after handling money, a known contaminant, at the order counter. Further, users often refill beverages in such environments shortly after handling or eating food providing a ripe opportunity for contamination.

Even indirect user contact with dispensers can present significant consumer safety issues. Health departments recognize the sanitary concerns posed by activation levers contacting the cup during dispensing, even without direct user contact. Saliva and accompanying germs on the cup can be transmitted to the dispenser by, e.g., migrating up the activation lever.

Some dispensers have attempted to limit user interaction by automating aspects of dispensing. For example, some dispensers are enabled with autofill technology that allows at least some aspects of dispensing to be automated, e.g., virtual activation levers that start and stop dispensing when a virtual plane is broken by a cup. While such dispensers can limit user interaction, current autofill technology performs inconsistently and may result in over or under filling of the cup. Overfilling is a particularly unacceptable result because it is both wasteful and messy. The inconsistent performance can severely hamper consumer satisfaction, especially given consumer expectations from decades of directly interacting with the dispensers and manually controlling fill level.

Dispensers equipped with ultrasonic-based autofill technology are one example of inconsistent autofill technology. Traditional ultrasonic-based autofill technology can require placing the cup at a specific location (e.g., on the drain grill) below the nozzle so that the dispensing can be monitored using an ultrasonic proximity sensor. Such ultrasonic proximity sensors are known to operate erratically during quick temperature changes, e.g., when in the vicinity of heating and cooling air vents present in environments in which dispensers are deployed. Erratic operation may also arise from ultrasonic signals ricocheting off of adjacent cups, spilled ice or beverages, etc. Erratic operation may also be caused by ultrasonic pest repellant devices that emit ultrasonic signals that disrupt the functionality of the ultrasonic-based autofill technology.

Embodiments described herein utilize one or more time of flight (ToF) sensors to automate aspects of dispensing and thereby limit user interaction with the dispenser with improved performance consistency relative to existing autofill dispenser.

Embodiments include a contactless autofill beverage dispenser for dispensing a beverage, ice, or both. The dispenser can include a ToF sensor. The ToF sensor can include an emitter that can emit a signal (e.g., infrared laser light) towards a target object (e.g., a cup, beverage, ice, etc.). The ToF sensor can include a receiver that receives the signal reflected back off the target object. The ToF sensor can enable ToF dispensing for accurate, contactless, autofill of the cup.

In embodiments, ToF dispensing can include sensing a presence of the cup. For example, the ToF sensor may emit a signal that reflects off the cup and indicates a presence of the cup.

In embodiments, ToF dispensing can include determining a characteristic of the cup. The characteristic can include, for example, a size, shape, or volume of the cup. Determining a characteristic of the cup can include calculating the distances between the ToF sensor and the cup. The calculated distances can be processed to model the aspects of the cup (e.g., create a depth map or three-dimensional (3D) representation of the target object), sense a presence of the cup, or continuously monitor a fill level of beverage or ice within the cup.

In embodiments, calculating the distances between the ToF sensor and the cup can include emitting infrared laser light from the ToF sensor towards the cup. The infrared laser light can bounce off the cup and the reflected infrared laser light can be received by the ToF sensor. The round trip time between emission of the signal and reception of the return signal reflected off of the object can be measured. Based upon a known speed of the infrared laser light and the measured round trip time, the distance between points of the cup and the ToF sensor can be calculated.

In embodiments, ToF dispensing can include initiating dispensing of the beverage or ice and continuously monitoring a fill level of the beverage or ice within the cup. Continuously monitoring the fill level can include calculating the distance between the ToF sensor and the beverage or ice within the cup. In embodiments, monitoring the fill level may include using the calculated distance to model the beverage or ice within the cup.

In embodiments, ToF dispensing can include determining that the fill level has reach a predetermined threshold and terminating dispensing.

In embodiments, the dispenser can include only a single ToF sensor. Such embodiments may help control costs.

In alternative embodiments, the dispenser may include a plurality of ToF sensors, e.g., a first ToF sensor and second ToF sensor. Such embodiments may improve the accuracy of the ToF dispensing. For example, the first ToF sensor can be optimized for determining characteristics of the cup, e.g., the first ToF sensor can be mounted on the dispenser at a position above the cup and with a direct line of sight into the cup determining a characteristic of the cup, e.g., a size, shape, or volume of the cup. The second ToF sensor can be optimized for determining a fill level of beverage or ice in the cup. For example, the second ToF sensor can be mounted on the dispenser at a position to the side of the cup to optimize a view of the fill level of beverage or ice within the cup.

In embodiments, the ToF dispensing can be completely automatic.

In embodiments, the ToF dispensing can be hands-free and completely contactless.

In embodiments, the ToF sensor can include a computer for controlling any or all aspects of the ToF dispensing.

In alternative embodiments, any or all aspects of the ToF dispensing can be performed by a computer incorporated into the dispenser, e.g., in a controller. In some embodiments all of the aspects can be performed by the controller of the dispenser and the ToF sensor can be provided without a computer.

In embodiments, the ToF sensor can be an infrared sensor configure to emit infrared laser light and to detect infrared light reflected from a target object.

In embodiments, the ToF sensor can function without any supplemental light emission source.

In embodiments, models of the cup can be created solely from the calculated distances and without analyzing any optical images of the target object.

In embodiments, the ToF sensor can be retrofitted onto an existing dispenser.

ToF sensors employed in embodiments can be used to automate dispensing precisely and quickly, particularly when compared with existing ultrasonic sensors. These precise and fast operation of the ToF sensors allow for the rapid creation of a high resolution 3D images of the cup. Further, the ToF sensors can operate unaffected by humidity, air pressure, and temperature improving the accuracy of the measurements and making the contactless dispensers suitable for outdoor and indoor use.

ToF sensors employed in embodiments can be easily customizable for different applications. For example, ToF sensors can detect objects of a variety of shapes and sizes and at a number of distances from the ToF sensors. Further, the field of view can be customizable depending on the particular dispensing application.

ToF sensors employed in embodiments can be safe. For example, in embodiments ToF sensors use low power infrared laser light driven by modulated pulse, which are safe to human eyes.

ToF sensors employed in embodiments can be compact and readily integrated into new or existing dispensers.

ToF sensors employed in embodiments can robustly function in various light conditions.

ToF sensors employed in embodiments can be easily mechanically and electrically integrated into new or existing dispensers.

Embodiments further include a process of automatically filling a cup using a contactless autofill dispenser. In embodiments, the process can employ any of the dispenser embodiments discussed above.

The process can include receiving a selection of a consumable product for the dispenser to dispense. The process can further include sensing, with a ToF sensor of the dispenser, the presence of the cup and automatically determining characteristics (e.g., size, shape, volume) of the cup. The process can further include controlling dispensing from the dispenser based upon the determined characteristics of the cup. The process can further include continuously monitoring, using the ToF sensor, a fill level of dispensed beverage or ice in the cup. The process can further include determining, based on the continuous monitoring of the level of dispensed beverage or ice in the cup, that the cup has filled to a predetermined level and automatically terminating dispensing based upon the determination that the cup is full.

In embodiments, the same, single ToF sensor can be used throughout the process. Such embodiments may limit costs associate with the range imaging system.

In alternative embodiments, multiple ToF sensors can be used in the process. Such embodiments may improve the accuracy of the ToF measurements. For example, a first ToF sensor may sense the presence of the cup and automatically determine characteristics (e.g., size, shape, volume) of the cup and a second ToF sensor may continuously monitor the level of dispensed beverage or ice in the cup.

In embodiments, the process can perform an automatic timed top-off dispense after determining that the cup has filled to the predetermined level and before automatically terminating dispensing.

These and other embodiments are discussed below with reference to FIGS. 1-4. Those skilled in the art will readily appreciate that the detailed description given herein with respect to these figures is for explanatory purposes only and should not be construed as limiting.

Figure 2:
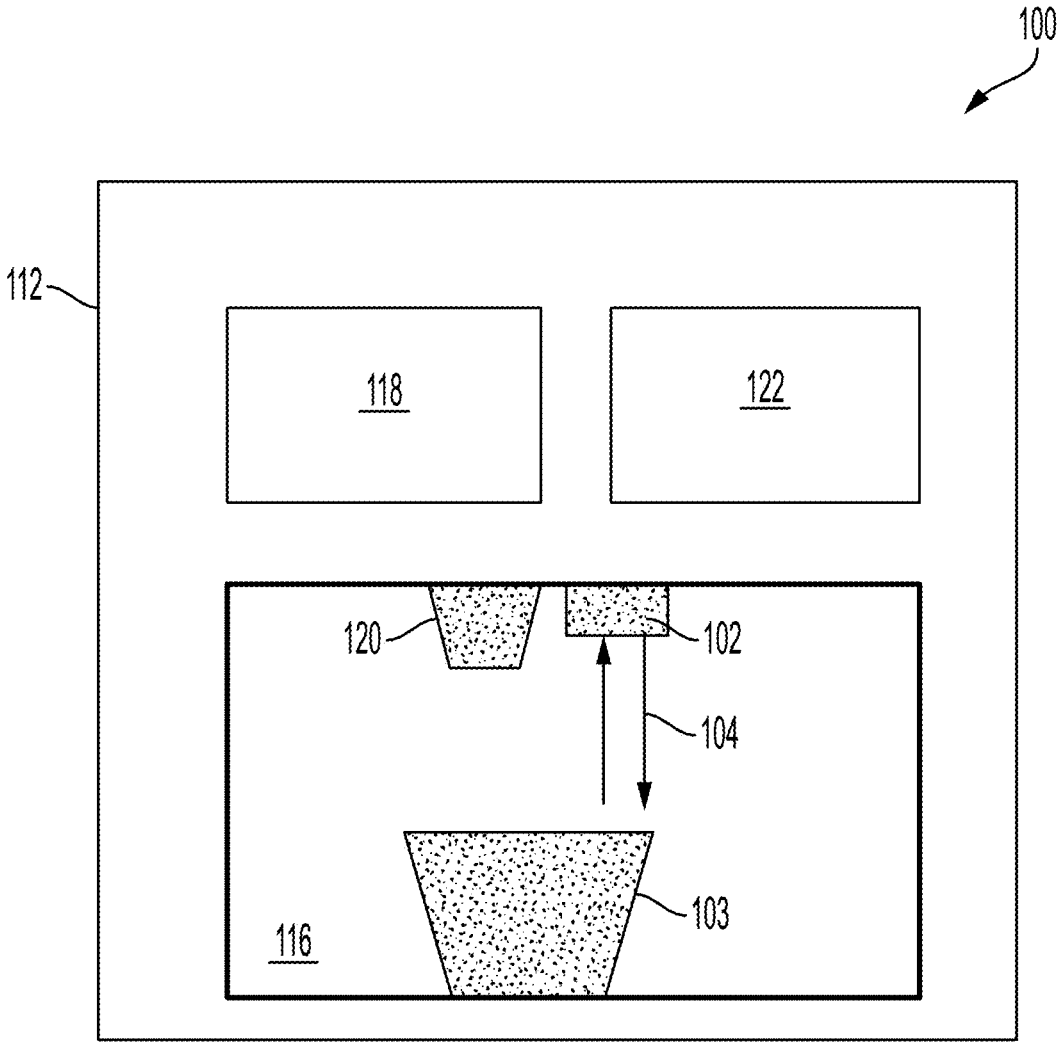
FIG. 2 shows a schematic view of an example dispenser according to an embodiment.
Figure 3:
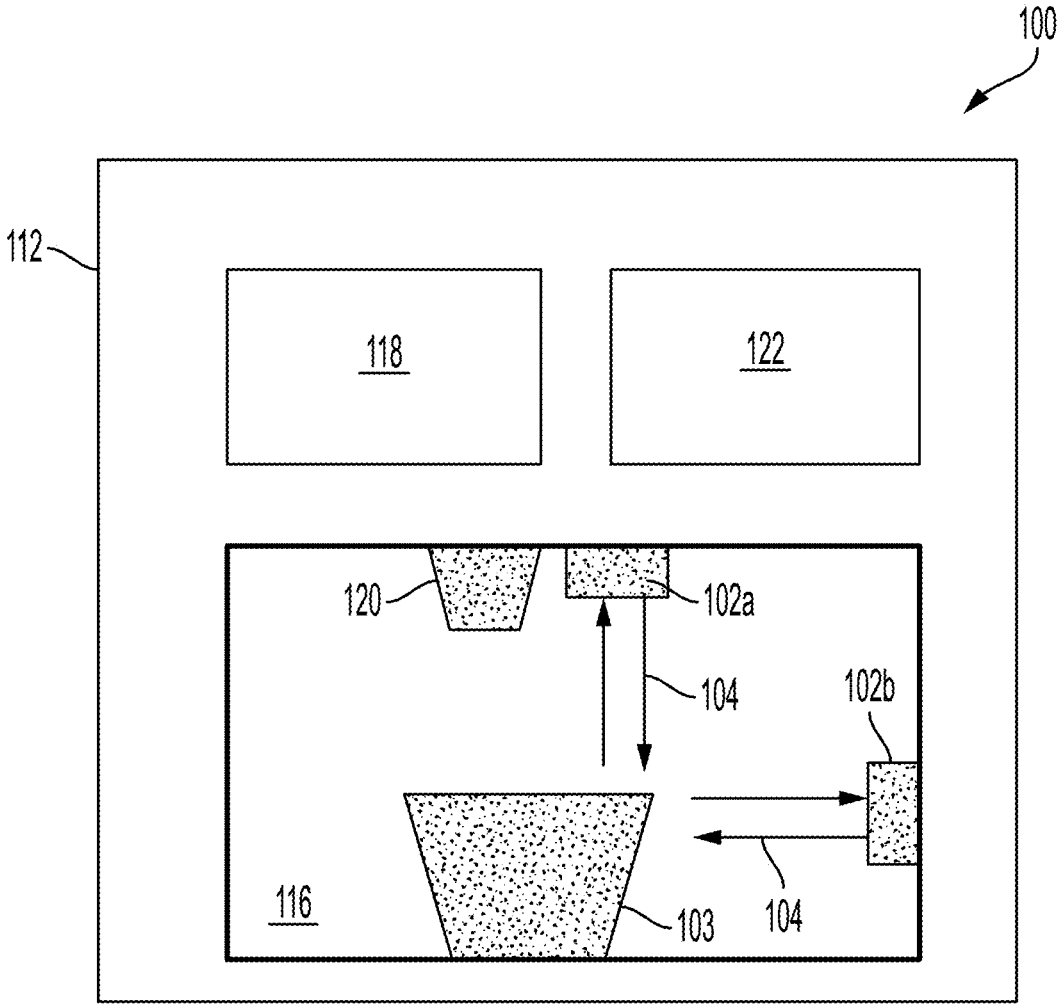
FIG. 3 shows a schematic view of an example dispenser according to another embodiment.

FIGS. 1-3, show example contactless autofill dispenser 100 embodiments. Dispenser 100 can include at least one ToF sensor 102 for enabling ToF dispensing control. ToF dispensing can include dispensing based upon information about a cup 103, received from ToF sensor 102. The term "cup," as used herein can mean any receptacle that can hold consumable product dispensed from dispenser 100 including cups, containers, bottles, pitchers, bags etc. The information can include the round trip time necessary for a light signal 104 emitted from ToF sensor 102 and reflected off a target object T, e.g., cup 103, to return to ToF sensor 102. ToF dispensing control can be based upon the information from sensed cup 103. ToF dispensing control can automatically control dispensing without the need for user to directly contact dispenser 100. For example, ToF dispensing control can cause dispenser 100 to automatically sense a presence of cup 103, determine a characteristic of cup 103, continuously monitor dispensing of consumable product within cup 103, and automatically start and stop dispensing.

Figure 4:
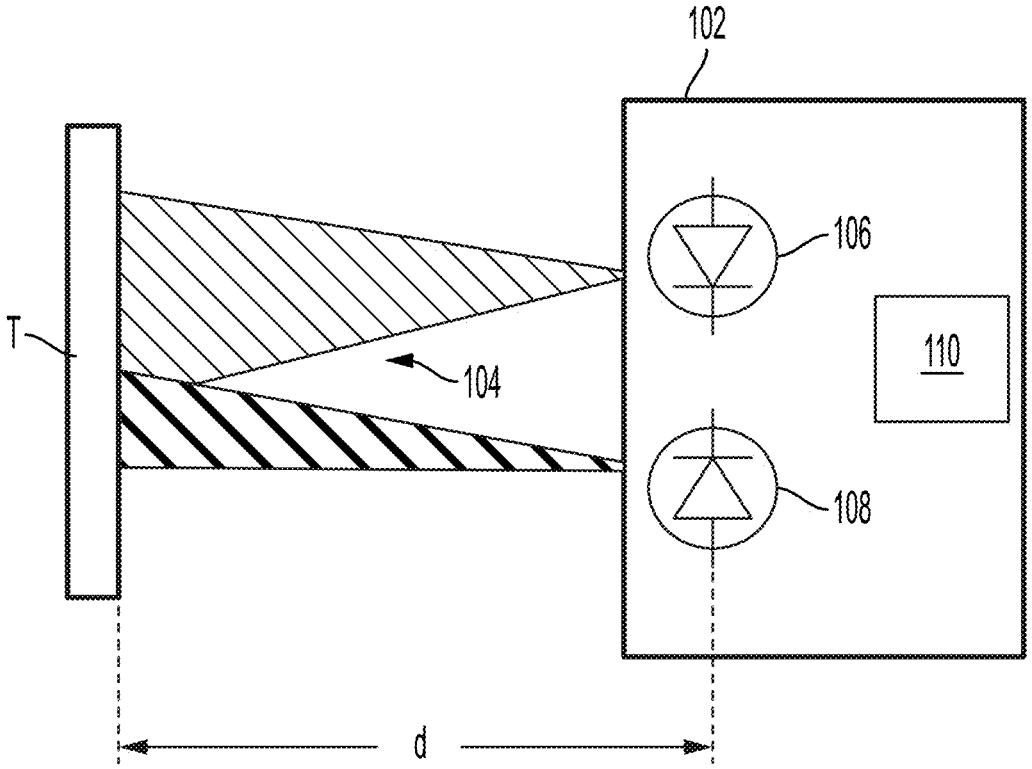
FIG. 4 shows a schematic view of an example time of flight sensor according to an embodiment.

FIG. 4 shows an example ToF sensor 102. ToF sensor 102 can include an emitter 106 that can emit light signal 104. ToF sensor 102 can include a receiver 108 that receives light signal 104 after light signal 104 is reflected off target object T, such as cup 103. The round trip time between emission and reception of light signal 104 can be used to calculate a distance d between ToF sensor 102 and target object T.

In embodiments, emitter 106 can be a light source that can be actively modulated.

In embodiments, the light source may produce an infrared laser light signal 104. Infrared laser light signal 104 can be emitted at a wavelength different than wave lengths typical to sunlight near dispenser 100 to reduce sunlight interference with ToF sensor 102.

In embodiments, receiver 108 may include an array of pixels, such as a complementary metal oxide semiconductor array (CMOS) or similar array. Each pixel may include a photodetector that can detect light signal 104 emitted from emitter 106 and convert light signal 104 into electrical signals for processing. Receiver 108 can have any number of pixels. Distance measurements between receiver 108 and the target object T can be calculated on a per pixel basis. Thus, a plurality of distance measurements can be collected simultaneously using the different pixels of the array resulting in rapid, high information resolution of cup 103.

In embodiments, the ToF sensor 102 can be a pulsed time-of-flight camera. The pulsed time-of-flight camera can include near infrared LEDS that can provide a multipart image with two dimensional (2D) and 3D data in one shot. Both light source (e.g., emitter 106) and image acquisition (e.g., receiver 108) can be synchronized in such a way that distances (e.g., between the ToF sensor 102 and cup 103) can be extracted and calculated from the multipart image with the 2D and 3D data.

In embodiments, the ToF sensor 102 can be a photoelectric 3D sensor. The photoelectric 3D sensor can measure the distance to the nearest surface (e.g., of cup 103) point by point using the ToF techniques. For example, the photoelectric 3D sensor can illuminate the dispense area 116, discussed subsequently herein, with an internal infrared light and calculate the distance (e.g., between the ToF sensor 102 and cup 103) using the light reflected from the surface (e.g. of cup 103).

In embodiments, ToF sensor 102 can include a ToF sensor computer 110 that can control features of ToF sensor 102, as discussed subsequently herein.

As shown in FIGS. 1 and 2, in embodiments dispenser 100 can include only a single ToF sensor 102. ToF sensor 102 can be mounted at any number of locations within or with a direct line of sight into dispense area 116, discussed subsequently herein. For example, ToF sensor 102 can be mounted on dispenser 100 at a position above cup 103 and with a direct line of sight into cup 103 to accurately determine a characteristic of cup 103, e.g., a size, shape, or volume of cup 103, and to monitor dispensed product dispensed therein. Such embodiments may help control costs.

As shown in FIG. 3, in alternative embodiments, dispenser 100 may include a plurality of ToF sensors, e.g., a first ToF sensor 102*a* and second ToF sensor 102*b*. Such embodiments may improve the accuracy of ToF dispensing control.

In embodiments, first ToF sensor 102*a* can be optimized for determining characteristics of cup 103. For example, first ToF sensor 102*a* can be mounted on dispenser 100 at a position above cup 103 and with a direct line of sight into cup 103 to accurately determine a characteristic of cup 103, e.g., a size, shape, or volume of cup 103.

In embodiments, second ToF sensor 102*b* sensor can be optimized for determining a fill level of consumable product in cup 103. For example, second ToF sensor 102*b* can be mounted on dispenser 100 at a position to the side of cup 103 to optimize a view of the fill level of consumable product within cup 103.

Dispenser 100 can include a housing 112. Dispenser 100 can further include dispense area 116 for receiving cup 103.

Dispenser 100 can include a supply 118 that can be disposed within housing 112. Supply 118 may contain consumable product. The term "consumable product," as used herein, can mean any ingestible substance dispensable from dispenser 100 including at least beverages, ice, and/or solid food. As used herein, the term "beverage" may refer to any free-flowing consumable liquid, such as water, or dairy-based beverages, such as milk, among others. Beverages can be provided with or without carbonation. Beverages can be provided with or without additive ingredients such as a particular flavoring, such as cola, grape, orange, lemon-lime, cherry, or vanilla, among others, or may refer to an enhancer (e.g., multi-vitamin complexes, minerals, and energy boosters), sweetener, or coloring, whether in the form of a liquid, syrup, or concentrate, or other form. As used herein, the term "solid food" may refer to, for example, bulk solid food such as nuts, oatmeal, chips, etc.

Supply 118 can include any combination of containers, pumps, pathways, conduits, valves, lines, refrigeration, etc. for storing in and conveying the consumable product throughout housing 112 of dispenser 100.

Dispenser 100 can include an outlet 120 that can be connected to supply 118 and can extend into dispense area 116 for dispensing consumable product.

In embodiments, outlet 120 can include a nozzle for dispensing a beverage.

In embodiments, outlet can include a chute for dispensing ice or solid food.

In embodiments, dispenser 100 can include a plurality of outlets 120. As shown in FIG. 1, dispenser 100 can include both a nozzle 120*a* for dispensing beverage and a chute 120*b* for dispensing ice.

As depicted in FIG. 1, in embodiments dispenser 100 can dispense a plurality of different beverages from a single nozzle 120*a*.

In embodiments, dispenser 100 can include a plurality of nozzles. Any of the plurality of nozzles may dispense one more beverages therefrom.

In embodiments, dispenser 100 can include a plurality of nozzles. Each of the plurality of nozzles can dispense a single dedicated beverage.

In embodiments, dispenser 100 can include one or more chute, with or without one or more nozzles, for dispensing ice or solid food.

In embodiments, dispenser 100 can include a plurality of chutes, each of the plurality of chutes can dispense a dedicated solid food.

Dispenser 100 can include a controller 122 that can be disposed within housing 112 and that can control dispensing of consumable product from dispenser 100. Controller 122 can be a computer. For example, controller 122 can include a valve control board that can control opening and closing of valves of supply 118 to initiate or terminate dispensing.

In embodiments, controller 122 can include a graphic user interface (GUI). The GUI can display messages to a user.

For example, the GUI can display a message indicting that dispenser 100 is automatically filling cup 103, e.g. "Auto filling cup," or the like.

In alternative embodiments, controller 122 can be provided without a GUI.

Additionally or alternatively, controller 122 can include a microphone and a speaker. The microphone can receive voice commands from a user that can be processed for use in ToF dispensing control, discussed subsequently herein. The speaker can provide updates to the user, such as the status of dispenser 100, the status of ToF dispensing control, etc. The microphone and speaker may be used in ToF dispensing control such that dispenser 100 can be operated without any direct physical contact from the user.

Additionally or alternatively, controller 122 can include a camera. The camera can detect movement (e.g., a gesture from a user) near dispenser 100. The detected movements can be used in ToF dispensing control such that dispenser 100 can be operated without any direct physical contact from the user.

ToF Dispensing Control

The following includes examples of ToF dispensing control that can be employed by dispenser 100. In embodiments, the ToF dispensing control can be implemented independently by ToF sensor computer 110, independently by controller 122, or aspects of ToF dispensing control can be shared by ToF sensor computer 110 and controller 122.

ToF dispensing control can include automatically detecting a presence of cup 103 in dispense area 116. The presence of cup 103 can be detected by ToF sensor 102 without any direct user contact with dispenser 100. For example, light signal 104 can be emitted by ToF sensor 102 and the return of light signal 104 reflected off cup 103 can be processed and the result can indicate that cup 103 is present in dispense area 116.

In embodiments, ToF sensor 102 may automatically scan for cup 103 at predetermined time intervals so that the presence of cup 103 can be detected without any user interaction.

In embodiments, a user, such as a customer or employee, may remotely communicate a consumable product selection to controller 122 without any direct user contact with dispenser 100. The selection can be remotely communicated for example using voice communication or with a computing device networked to controller 122, such as a mobile phone or smart cash register.

ToF dispensing control can include determining a characteristic of cup 103, such as a size, shape, volume, etc. Determining the characteristic can be automatically performed in response to the sensed presence of cup 103. The characteristic can be determined by measuring the round trip time between emission of light signal 104 and reception of return light signal 104 reflected off of the object. Based upon a known speed of light signal 104 and the measured round trip time, the distance between points of cup 103 and ToF sensor 102 can be calculated. The characteristic of cup 103 can be determined based upon the distances between points of cup 103 and ToF sensor 102. In embodiments, the distances between points of cup 103 and ToF sensor 102 can be processed into a depth map or 3D model of cup 103.

In embodiments, only one sensor (e.g., first ToF sensor 102*a*) can be employed to determine the characteristic of cup 103.

In alternative embodiments, more than one sensor (e.g., first ToF sensor 102*a* and second ToF sensor 102*b*) can be employed together to determine the characteristic of cup 103.

ToF dispensing control can include initiating dispensing of the consumable product. In embodiments, dispensing can be automatically initiated in response to any or both of sensing the presence of cup 103 and determining a characteristic of cup 103.

In embodiments, initiating dispensing can include setting an automated shut off period for dispenser 100 in response to the characteristic of cup 103. An automated shut off period may mitigate overfilling of cup 103 that can be caused by fouling on ToF sensor 102, such as when consumable product splashes onto and adheres to ToF sensor 102.

In embodiments, the automated shut off period can be a default setting independent of cup 103.

In alternative embodiments, the automated shut off period can be based upon, e.g., the volume of cup 103 and a known rate of dispense of the consumable product.

In embodiments, dispenser 100 or ToF dispensing control can include additional or alternative features to mitigate or eliminate sensor interference from fouling. For example, ToF sensing control can include automated operator alerts to perform timed cleanings at set intervals. ToF sensing control can include self-diagnosis capabilities for early detection that the ToF sensor is not operating within normal limits. Further, the location of the ToF sensor 102 relative to outlet 120 may be optimized to minimize impact of splashing.

ToF dispensing control can include monitoring a fill level of the consumable product within cup 103. Monitoring the fill level can include measuring the round trip time between emission of light signal 104 and reception of return light signal 104 reflected off of cup 103. A degree of transmission of light signal 104 through cup 103 can be monitored to determine fill level within cup 103. Additionally or alternatively, light signal 104 may reflect directly off the consumable product to directly measure the fill level within cup 103. Based upon a known speed of light signal 104 and the measured round trip time, the distance between points of cup 103 and ToF sensor 102 can be calculated. The fill level can be determined based upon the distances between points of cup 103 and ToF sensor 102. In embodiments, the distances between points of cup 103 and ToF sensor 102 can be processed into a depth map or 3D model of the fill level of the consumable product within cup 103.

In embodiments, the fill level can be monitored at set intervals.

In embodiments, the fill level can be monitored continuously, i.e., in real-time and as quickly as ToF sensor 102 and processing power will allow.

In embodiments, only one sensor (e.g., second ToF sensor 102*b*) can be employed to monitor the fill level.

In alternative embodiments, more than one sensor (e.g., first ToF sensor 102*a* and second ToF sensor 102*b*) can be employed together to monitor the fill level.

ToF dispensing control can include determining that the fill level has reached a predetermined threshold and terminating dispensing. That is, the monitored fill level can be compared to the threshold and dispensing can be terminated when the monitored fill level approaches or exceeds the threshold.

In embodiments, the threshold can be based upon the characteristic of cup 103. For example, the threshold can be a threshold volume of cup 103.

In embodiments, the threshold volume of cup 103 can be less than a full volume of cup 103 and dispenser 100 can perform an automated top off to fill the remaining volume of cup 103.

Figure 5:
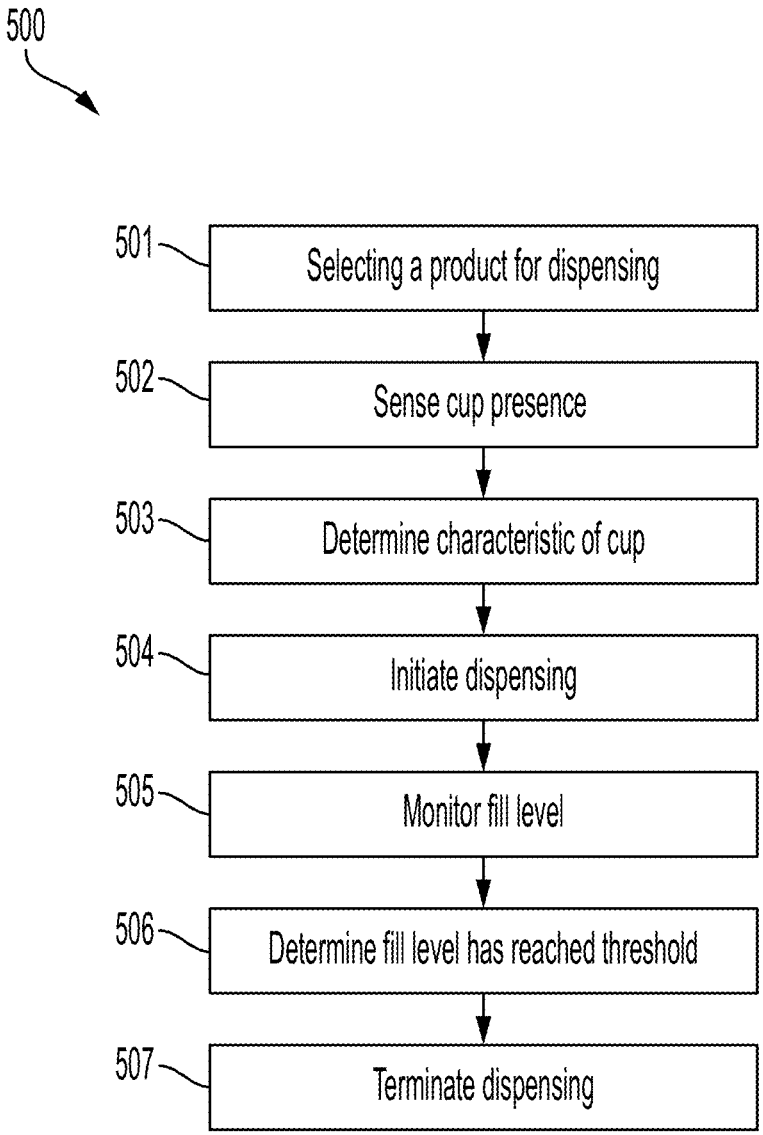
FIG. 5 shows an exemplary process of contactless dispensing according to an embodiment.

FIG. 5 shows an example process 500 of contactless dispensing. Embodiments of process 500 can be implemented using any dispenser 100 embodiments discussed above. Process 500 may implement any or all aspects of ToF dispensing control embodiments discussed above.

For example, in embodiments, process 500 can include, at a first step 501, receiving a selection of a consumable product (e.g., a beverage with or without ice) for dispenser 100 to dispense.

In embodiments, receiving a selection of a consumable product at step 501 can include a user, such as a customer or employee, remotely communicating a consumable product selection to controller 122 without any direct user contact with dispenser 100. For example, the user may select one of a plurality of beverages that dispenser 100 is configured to dispense. The selection can be remotely communicated for example using voice communication or with a computing device networked to controller 122, such as a mobile phone or smart cash register.

In embodiments, receiving a selection of a consumable product at step 501 can include a user placing cup 103 in dispense area 116.

At step 502, process 500 can include sensing a presence of cup 103. Step 502 can include any embodiments of sensing a presence of cup 103 previously described in the description of ToF dispensing control.

At step 503, process 500 can include determining a characteristic of cup 103. Step 503 can include any embodiments of determining a characteristic of cup 103 previously described in the description of ToF dispensing control.

At step 504, process 500 can include initiating dispensing of consumable product from dispenser 100. Step 504 can include any embodiments of initiating dispensing of consumable product previously described in the description of ToF dispensing control.

At step 505, process 500 can include monitoring a fill level of consumable product dispensed into cup 103. Step 505 can include any embodiments of monitoring a fill level of consumable product previously described in the description of ToF dispensing control.

At step 506, process 500 can include determining that the fill level has reached a predetermined threshold. Step 506 can include any embodiments of determining the fill level has reached a predetermined threshold previously described in the description of ToF dispensing control.

At step 507, process 500 can include terminating dispensing of consumable product. Step 507 can include any embodiments of terminating dispensing of consumable product described previously in the description of ToF dispensing control.

In embodiments, each of steps 501-507 are performed automatically by dispenser 100 without the user making any direct contact with dispenser 100.

Figure 6:
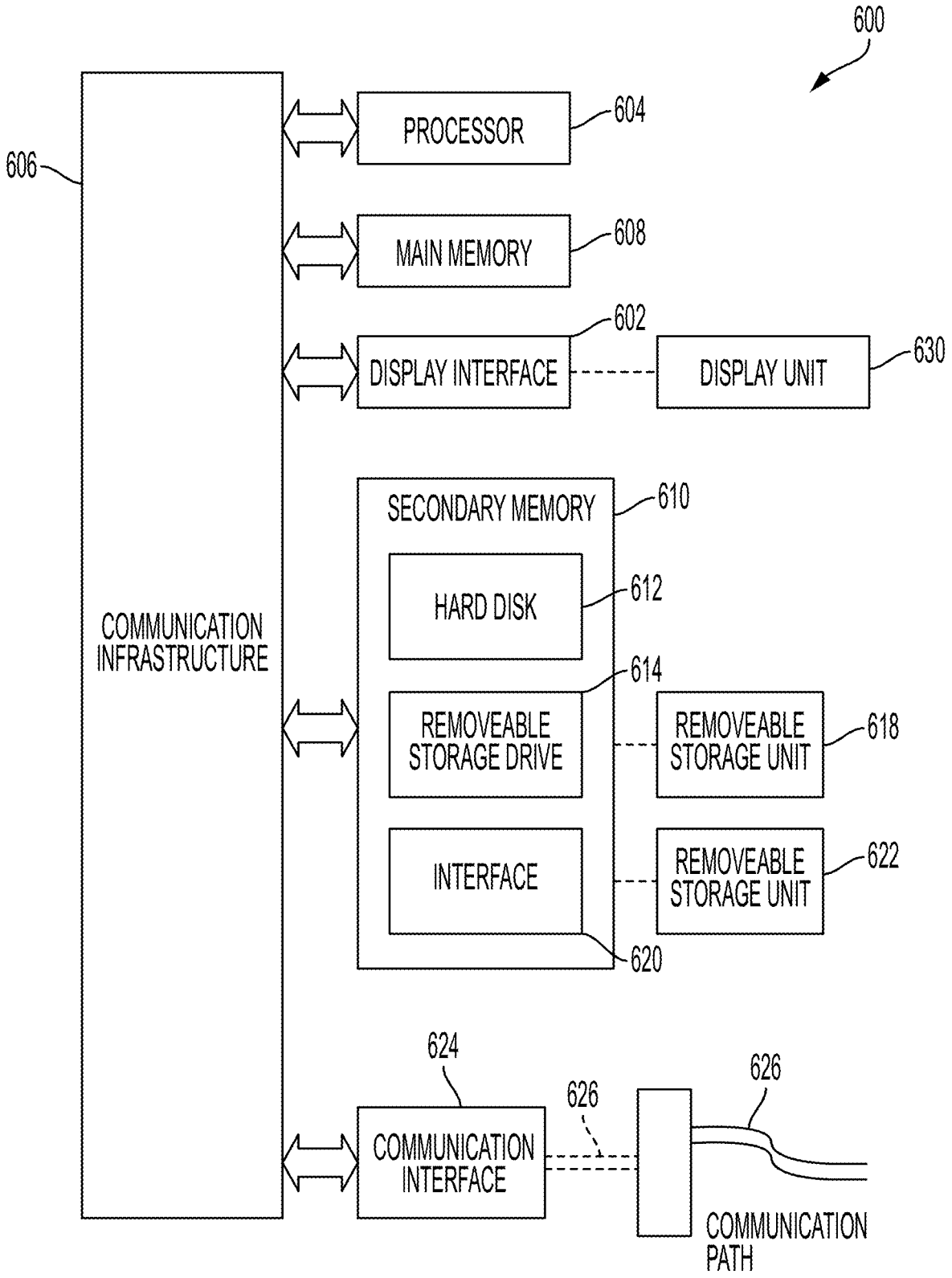
FIG. 6 shows a schematic view of an example computer according to an embodiment.

As discussed previously, ToF sensor computer 110 and controller 122 may each include a computer. FIG. 6 illustrates an example computer 600, aspects of which can be incorporated into embodiments of ToF sensor computer 110 and controller 122.

In embodiments, computer 600 can be implemented as computer-readable code.

If programmable logic is used, such logic may execute on a commercially available processing platform or a special purpose device. One of ordinary skill in the art may appreciate that embodiments of the disclosed subject matter can be practiced with various computer configurations, including multi-core multiprocessor systems, minicomputers, and mainframe computers, computer linked or clustered with distributed functions, as well as pervasive or miniature computers that can be embedded into virtually any device.

For instance, at least one processor device and a memory can be used to implement the above described embodiments. A processor device can be a single processor, a plurality of processors, or combinations thereof. Processor devices may have one or more processor "cores."

Various embodiments of the inventions can be implemented in terms of this example computer 600. After reading this description, it will become apparent to a person skilled in the relevant art how to implement one or more of the inventions using other computers or computer architectures. Although operations can be described as a sequential process, some of the operations may in fact be performed in parallel, concurrently, or in a distributed environment, and with program code stored locally or remotely for access by single or multi-processor machines. In addition, in some embodiments the order of operations can be rearranged without departing from the spirit of the disclosed subject matter.

Processor 604 can be a special purpose or a general purpose processor device. As will be appreciated by persons skilled in the relevant art, processor 604 may also be a single processor in a multi-core/multiprocessor system, such system operating alone, or in a cluster of computing devices operating in a cluster or server farm. Processor 604 is connected to a communication infrastructure 606, for example, a bus, message queue, network, or multi-core message-passing scheme.

Computer 600 can include a main memory 608, for example, random access memory (RAM), and may also include a secondary memory 610. Secondary memory 610 may include, for example, a hard disk drive 612, or removable storage drive 614. Removable storage drive 614 may include a floppy disk drive, a magnetic tape drive, an optical disk drive, a flash memory, a Universal Serial Bus (USB) drive, or the like. The removable storage drive 614 reads from or writes to a removable storage unit 618 in a well-known manner. Removable storage unit 618 may include a floppy disk, magnetic tape, optical disk, etc. which is read by and written to by removable storage drive 614. As will be appreciated by persons skilled in the relevant art, removable storage unit 618 includes a computer usable storage medium having stored therein computer software or data.

Computer 600 may include a display interface 602 (which can include input and output devices such as keyboards, mice, etc.) that forwards graphics, text, and other data from communication infrastructure 606 (or from a frame buffer not shown) for display on a display unit 630.

In implementations, secondary memory 610 may include other similar means for allowing computer programs or other instructions to be loaded into computer 600. Such means may include, for example, a removable storage unit 622 and an interface 620. Examples of such means may include a program cartridge and cartridge interface (such as that found in video game devices), a removable memory chip (such as an EPROM, or PROM) and associated socket, and other removable storage units 622 and interfaces 620 which allow software and data to be transferred from the removable storage unit 622 to computer 600.

Computer 600 may also include a communication interface 624. Communication interface 624 allows software and data to be transferred between computer 600 and other devices, such as communication between ToF sensor computer 110 and controller 122, or between remote device used to initiate dispensing without directly contacting dispenser. Communication interface 624 may include a modem, a network interface (such as an Ethernet card), a communication port, a PCMCIA slot and card, or the like. Software and data transferred via communication interface 624 can be in the form of signals, which can be electronic, electromagnetic, optical, or other signals capable of being received by communication interface 624. These signals can be provided to communication interface 624 via a communication path 626. Communication path 626 carries signals and can be implemented using wire or cable, fiber optics, a phone line, a cellular phone link, an RF link or other communication channels.

In this document, the terms "non-transitory computer readable medium" "computer program medium" and "computer usable medium" can refer to media such as removable storage unit 618, removable storage unit 622, and a hard disk installed in hard disk drive 612. Computer program medium and computer usable medium may also refer to memories, such as main memory 608 and secondary memory 610, which can be memory semiconductors (e.g. DRAMs, etc.).

Computer programs (also called computer control logic) or databases are stored in main memory 608 or secondary memory 610. Computer programs may also be received via communication interface 624. Such computer programs, when executed, enable computer 600 to implement the embodiments as discussed herein. In particular, the computer programs, when executed, enable processor 604 to implement the processes of the embodiments discussed here. Accordingly, such computer programs represent controllers of computer 600. Where the embodiments are implemented using software, the software can be stored in a computer program product and loaded into computer 600 using removable storage drive 614, interface 620, and hard disk drive 612, or communication interface 624.

Embodiments of the inventions also can be directed to computer program products comprising software stored on any computer useable medium. Such software, when executed in one or more data processing device, causes a data processing device(s) to operate as described herein. Embodiments of the inventions may employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the following claims and their equivalents.

What is claimed is:

1. A contactless autofill beverage dispenser comprising:
- a housing;
- a dispense area for receiving a cup;
- a supply of consumable product disposed within the housing;
- an outlet connected to the supply and extending from the housing into the dispense area for dispensing the consumable product into the cup;
- a controller disposed within the housing and connected to the supply, wherein the controller is configured to control dispensing of the consumable product from the outlet; and
- a time of flight sensor with a direct line of sight into the dispense area and connected to the controller,
- wherein the time of flight sensor without any physical contact with the dispenser from a user is configured to:
- sense a presence of the cup;
- determine a characteristic of the cup; and
- initiate dispensing of the consumable product based upon the presence of the cup and the characteristic of the cup.

2. The contactless autofill beverage dispenser of claim 1, wherein the time of flight sensor without any physical contact from a user is configured to:
- automatically instruct the controller to initiate dispensing of the consumable product based upon the presence of the cup and the characteristic of the cup;
- continuously monitor a fill level of the consumable product in the cup; and
- automatically instruct the controller to terminate dispensing of the consumable product based upon the characteristic of the cup and the fill level of the consumable product in the cup.

3. The contactless autofill beverage dispenser of claim 2, wherein the time of flight sensor comprises:
- an emitter configured to emit a signal towards the cup;
- a receiver configured to receive the signal reflected off of the cup;
- a computer including a non-transitory computer-readable medium having instructions that when executed by the computer cause the computer to automatically:
  - control the emitter to emit the signal;
  - control the receiver to receive the signal reflected off of the cup; and
  - automatically instruct the controller to control dispensing based upon the signal reflected off the cup.

4. The contactless autofill beverage dispenser of claim 3, wherein the instructions when executed by the computer cause the computer to automatically sense the presence of the cup within the dispense area and to automatically instruct the controller to initiate the dispensing based upon the signal reflected off the cup.

5. The contactless autofill beverage dispenser of claim 3, wherein the instructions when executed by the computer cause the computer to automatically calculate a distance between the time of flight sensor and the cup based upon a time between emission of the signal by the emitter and receipt of the signal reflected off the cup.

6. The contactless autofill beverage dispenser of claim 5, wherein the instructions when executed by the computer cause the computer to automatically determine the characteristic of the cup based upon the distance between the time of flight sensor and the cup.

7. The contactless autofill beverage dispenser of claim 6, wherein the characteristic is a volume and the computer automatically instructs the controller to control dispensing based upon the volume.

8. The contactless autofill beverage dispenser of claim 3, wherein the signal is infrared laser light.

9. The contactless autofill beverage dispenser of claim 3, wherein automatically instruct the controller to control dispensing based upon the signal reflected off the cup includes continuously monitoring a fill level of consumable product within the cup and instructing the controller to terminate dispensing upon determining that the fill level has reached a predetermined threshold.

10. The contactless autofill beverage dispenser of claim 1, wherein the time of flight sensor comprises:

a first time of flight sensor mounted to the dispenser adjacent to the outlet with a direct line of sight into a bottom of the dispense area for holding the cup; and a second time of flight sensor mounted to the dispenser between the outlet and the bottom of the dispense by with a direct line of sight across the dispense area for viewing a side of the cup.

11. A contactless dispenser comprising:

a housing;

a dispense area for receiving a cup;

a supply of consumable product disposed within the housing;

an outlet connected to the supply and extending from the housing into the dispense area for dispensing the consumable product into the cup;

a controller disposed within the housing and connected to the supply, wherein the controller is configured to control dispensing of the consumable product from the outlet; and a time of flight sensor for enabling contactless dispensing without any physical contact from a user, the time of flight sensor comprising:

an emitter configured to emit an infrared laser light towards the cup;

a receiver configured to receive the infrared signal reflected off of the cup;

a computer including a non-transitory computer-readable medium having instructions that when executed by the computer cause the computer to automatically and without any physical contact from a user:

control the emitter to emit the infrared laser light;

control the receiver to receive the infrared signal reflected off of the cup; and instruct the controller to control dispensing based upon the infrared signal reflected off the cup.

12. The time of flight sensor of claim 11, wherein automatically instruct the controller to control dispensing is further based upon a distance between the cup and the time of flight sensor calculated by the time of flight sensor based upon a time for the infrared laser light to travel from the emitter to the cup and back to the receiver.

13. A method of contactless dispensing from a dispenser, the method comprising:

automatically sensing, with a time of flight sensor of the dispenser, a presence of a cup;

automatically determining, with the time of flight sensor, a characteristic of the cup in response to the sensed presence of the cup;

dispensing a consumable product from the dispenser based upon the presence of the cup and the characteristic of the cup;

continuously monitoring, with the time of flight sensor, a fill level of dispensed consumable product within the cup;

determining that the fill level has reached a predetermined threshold based upon the continuously monitored fill level; and terminating dispensing of the consumable product based upon the determination that the fill level has reached the predetermined threshold, wherein the entirety of the method is performed without direct user contact with the dispenser.

14. The method of claim 13, wherein the time of flight sensor comprises a first time of flight sensor and a second time of flight sensor, wherein automatically sensing the presence of the cup and automatically determining the characteristic of the cup is performed by the first time of flight sensor, and wherein continuously monitoring the fill level is performed by the second time of flight sensor.

15. The method of claim 13, wherein automatically determining the characteristic of the cup includes calculating a distance between the cup and the time of flight sensor based upon a time for infrared laser light to travel from the time of flight sensor to the cup and back to the time of flight sensor.

16. The method of claim 15, wherein the characteristic of the cup is a volume of the cup.

17. The method of claim 13, wherein continuously monitoring the fill level of dispensed consumable product within the cup includes calculating a distance between the cup and the time of flight sensor based upon a time for infrared laser light to travel from the time of flight sensor to the cup and back to the time of flight sensor.

18. The method of claim 13, further comprising performing an automatic top off of the consumable product subsequent to determining that the fill level has reached the predetermined threshold and prior to terminating dispensing of the consumable product.

19. The method of claim 13, further comprising, prior to automatically sensing the presence of the cup, placing the cup in a dispense area of the dispenser without a user directly contacting the dispenser.

* * * * *